US008336796B2

(12) United States Patent
Wark

(10) Patent No.: US 8,336,796 B2
(45) Date of Patent: Dec. 25, 2012

(54) IMPACTOR RING FOR UPDRAFT CLASSIFIERS

(76) Inventor: Rickey E. Wark, Spring, TX (US)

( * ) Notice: Subject to any disclaimer, the term of this patent is extended or adjusted under 35 U.S.C. 154(b) by 343 days.

(21) Appl. No.: 12/879,080

(22) Filed: Sep. 10, 2010

(65) Prior Publication Data

US 2012/0061497 A1 Mar. 15, 2012

(51) Int. Cl.
*B02C 15/00* (2006.01)

(52) U.S. Cl. ..... 241/119

(58) Field of Classification Search ..... 241/117–121
See application file for complete search history.

(56) References Cited

U.S. PATENT DOCUMENTS 4,605,174 A * 8/1986 Maliszewski et al. ..... 241/52
4,907,751 A * 3/1990 Wark et al. ..... 241/119
5,957,300 A * 9/1999 Nardi et al. ..... 209/143
6,079,646 A * 6/2000 Keyssner et al. ..... 241/47
7,712,692 B2 * 5/2010 Hall et al. ..... 241/197
7,753,303 B2 * 7/2010 Hall et al. ..... 241/275
2006/0022075 A1 * 2/2006 Wark ..... 241/119
2011/0114769 A1 * 5/2011 Wark ..... 241/119
2011/0168819 A1 * 7/2011 Wark ..... 241/119

* cited by examiner

*Primary Examiner* — Faye Francis
(74) *Attorney, Agent, or Firm* — Young Basile Hanlon & MacFarlane PC

(57) ABSTRACT

An annular impactor structure for use in crusher/classifiers of the updraft type. An annular structure comprising a plurality of radially inwardly projecting, essentially vertical impactor plates of high-hardness material is located immediately above a vane structure such that entrained particulate matter from a milling bowl impacts one or both of the impactor plate surfaces. The impactor plates as well as the backer structures between the impactor plates are covered with coin-shaped protrusions. The impactor plate structure can be used in combination with a single or double course vane structure.

11 Claims, 7 Drawing Sheets

IMPACTOR RING FOR UPDRAFT CLASSIFIERS

FIELD OF THE INVENTION

This invention relates to crusher/classifiers for milling coal, mineral ore and similar materials into fine particulates and more particularly to a structure which is effective to enhance the operating effects of a crusher/classifier of the updraft type.

BACKGROUND OF THE INVENTION

A well-known crusher/classifier used to pulverize coal and mineral ore employs a milling bowl of circular design around which air is caused to flow upwardly through an annular structure comprising angled vanes. The vane structure can be attached to the bowl to rotate with it, or be attached to the crusher/classifier housing just outside of the bowl. After passing through the vanes, the air picks up crushed particles and flows upwardly so as to impact the surface of an inwardly angled deflector which directs the air and particulates back toward the center of the crusher/classifier housing to enhance mixing and to ensure the return of heavier particles to the milling bowl for additional treatment. The air continues to flow upwardly to a classifier section and from there to a combustion chamber via ducts.

BRIEF SUMMARY OF THE INVENTION

The present invention provides an improvement to crusher/classifiers of the updraft type wherein air is caused to flow upwardly around a milling bowl through an annular structure comprising angled vanes. The vanes locally angle the upward flow of air according to the vane angle, before it continues upwardly toward a classifier. In accordance with the invention, an annular structure comprising a series of uniformly spaced-apart, inwardly-extending impactor plates is mounted on the classifier wall above the angled vanes. These impactor plates are essentially vertical and extend radially into the updraft airstream coming off of the vanes. Accordingly, the updraft air and particulates entrained therein impact one or both of the major surfaces of the impactor plates to break the particles down into smaller pieces, thus enhancing the pulverizing effect of the system.

I have found that the present invention is used to its greatest advantage when combined with a double-course vane structure comprising two concentric courses of vanes, the vanes in one course being angled in one direction and the vanes in the other course being angled in the opposite direction. Such a double-course vane structure is disclosed in my previously filed, pending patent application, Ser. No. 12/621,814 entitled "Double Course Vane Wheel" filed on Nov. 19, 2009. Using the double-course vane structure with vanes in one course set opposite to the vanes in the other course brings both major surfaces of the impactor plates into play and further enhances the pulverizing effect.

In the preferred form, the impactor plates of the present invention, as well as a ring structure anchoring the impactor plates, are provided with coin-shaped surface projections to substantially increase impact-pulverizing action. Although the coin shape is illustrated and described herein, it is merely an example of a variety of different surface shapes which can be used. The impactor plate surfaces are hardened or made of a highly wear-resistant material.

In accordance with a preferred embodiment of the invention, an overall structure suitable for use within an updraft crusher/classifier structure comprises an annular support and a plurality of radially inwardly extending impactor plates with opposite surfaces essentially covered with coin-shaped projections, the inner surface of the ring structure between the impactor plates being similarly covered with the projections described above. The structures, including the impactor plates and the ring structure, are preferably made of a high hardness alloy, a carbide or a metal oxide. As stated above, the preferred vane structure has two courses of opposite sense and may be fixed to the crusher housing interior wall or attached to the milling bowl so as to rotate with it.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
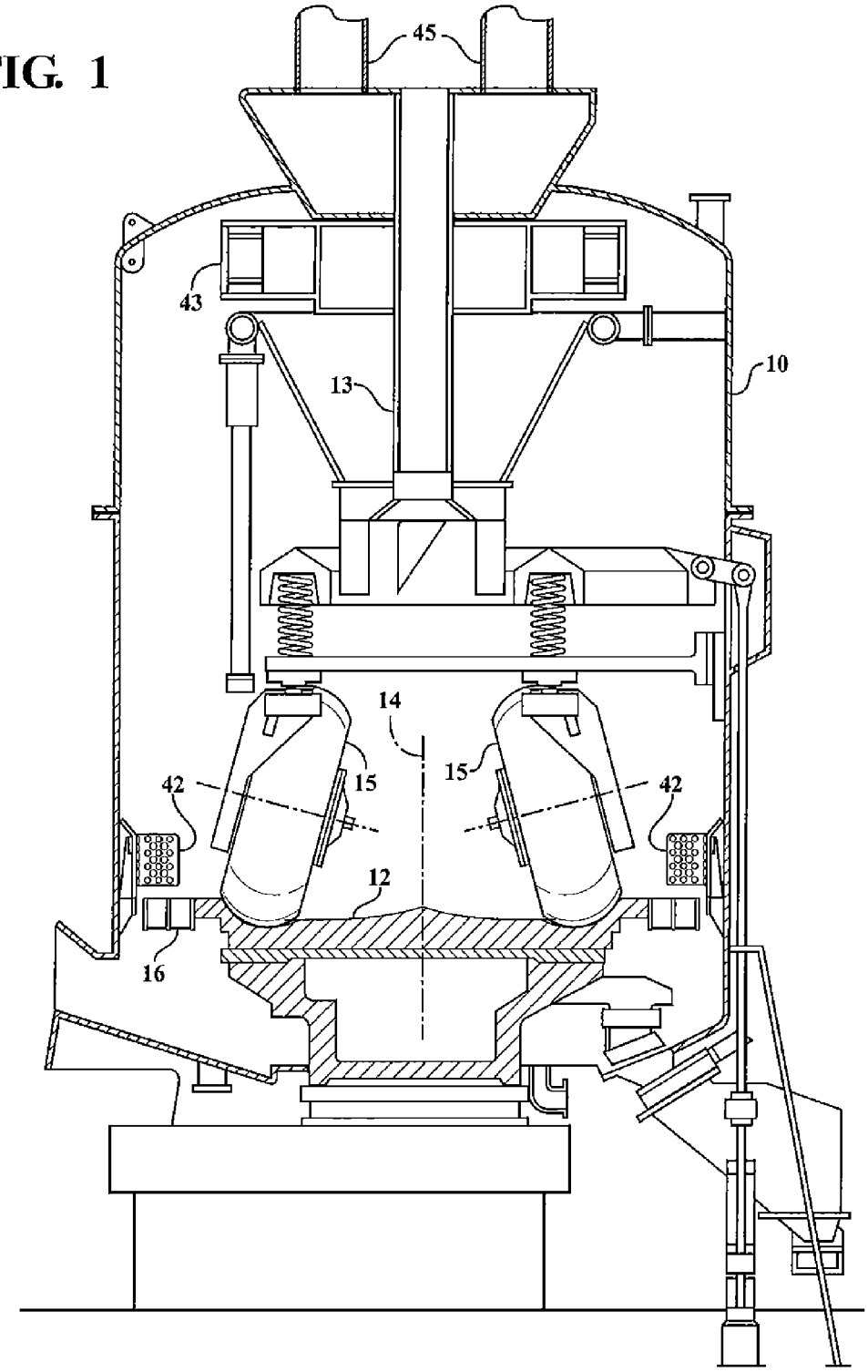
FIG. 1 is a side view, partly in section, of a crusher/classifier embodying the invention and a double-course vane wheel.
Figure 2:
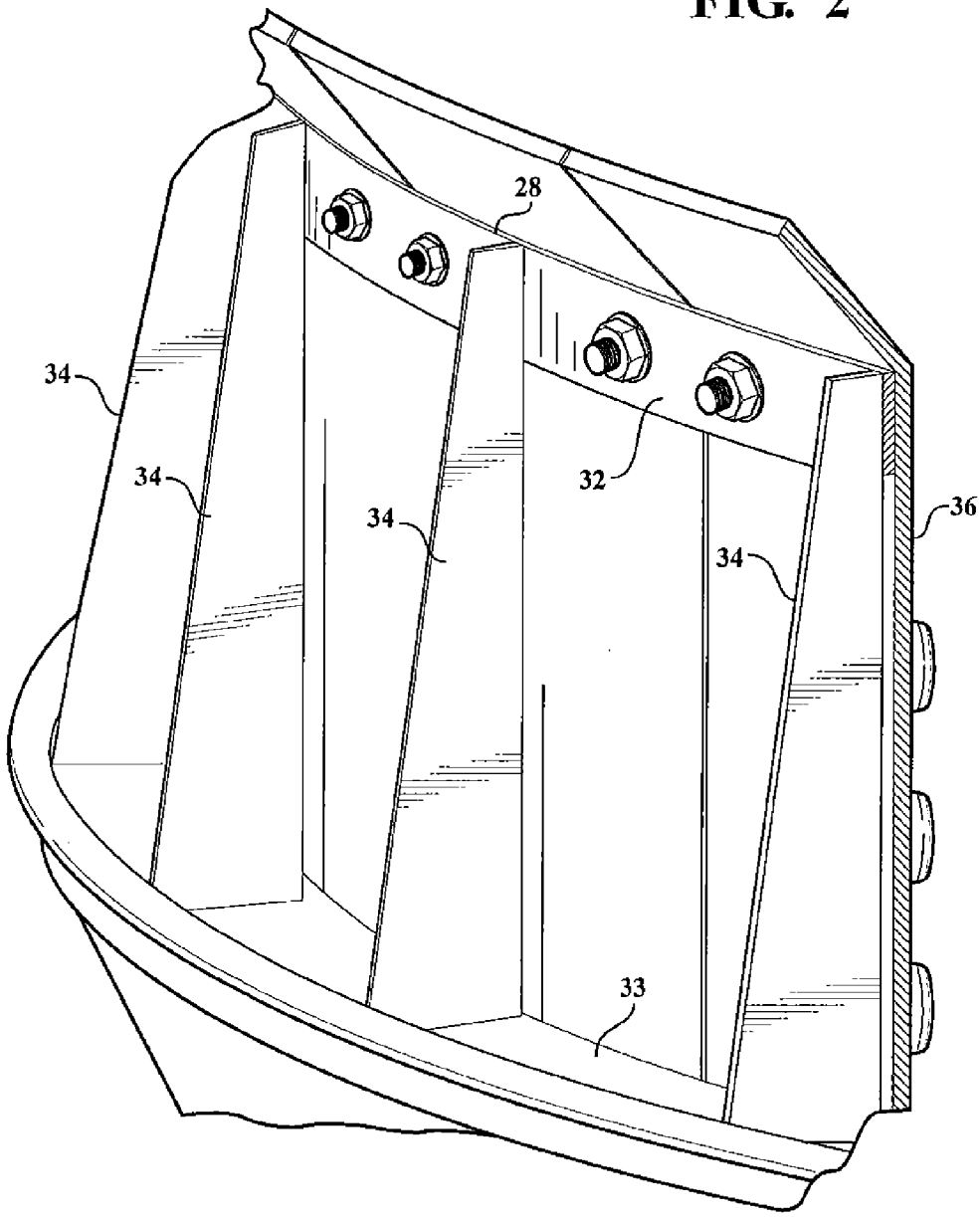
FIG. 2 is a perspective drawing of a section of the impactor structure from the exterior side.

Referring to the figures, there is shown a crusher/classifier comprising an upright housing 10 within which is rotatably mounted a dish-shaped milling bowl 12 having a vertical axis of rotation 14. Coal or other material falls through a chute 13 onto the bowl 12. The drive mechanism for rotating the milling bowl 12 as well as the crusher wheels 15 which ride thereon and the suspension systems for the crusher wheels are all well known and are described in greater detail in my previously issued U.S. Pat. Nos. 4,907,751, 5,386,619 and 5,819,947, the contents of which are incorporated herein by reference.

Figure 3:
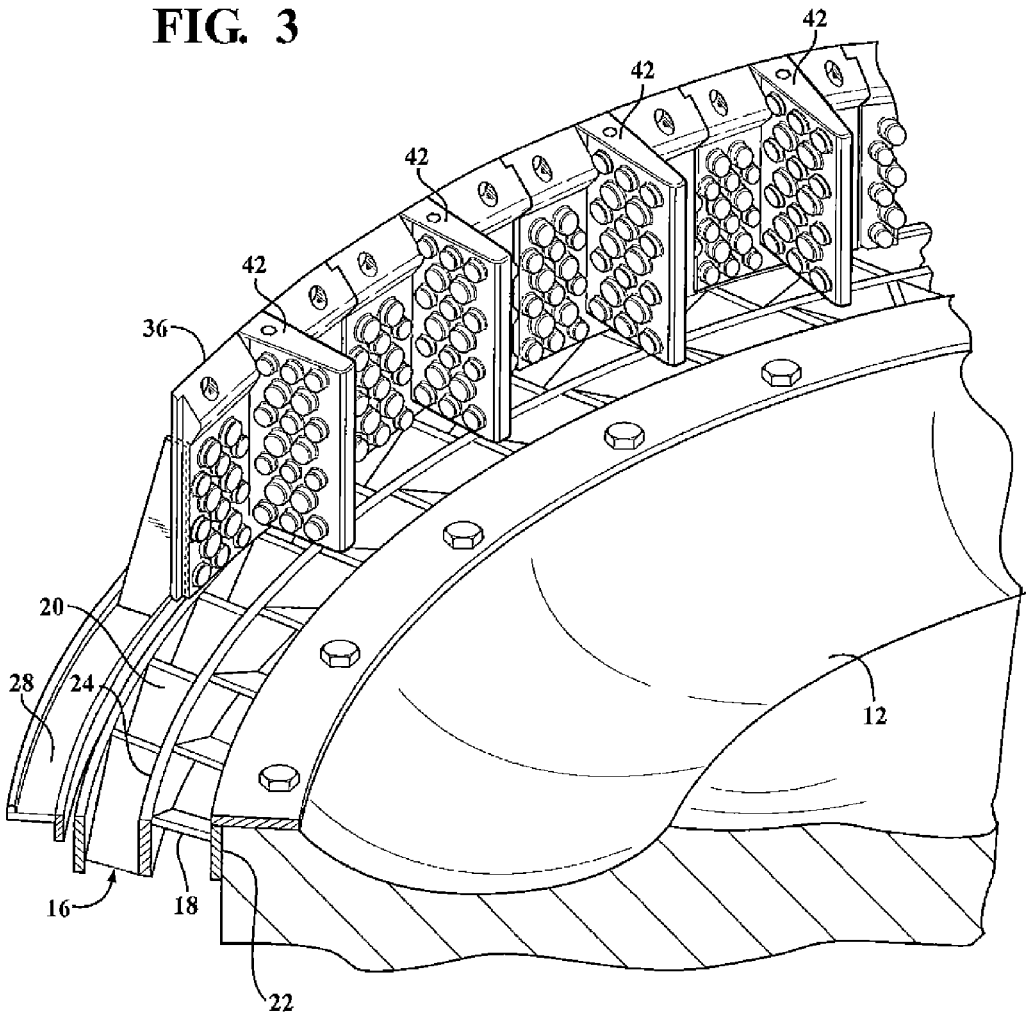
FIG. 3 is a perspective view of a portion of the milling bowl, a rotatable double-course vane wheel and a impactor structure from the embodiment of FIG. 1.
Figure 4:
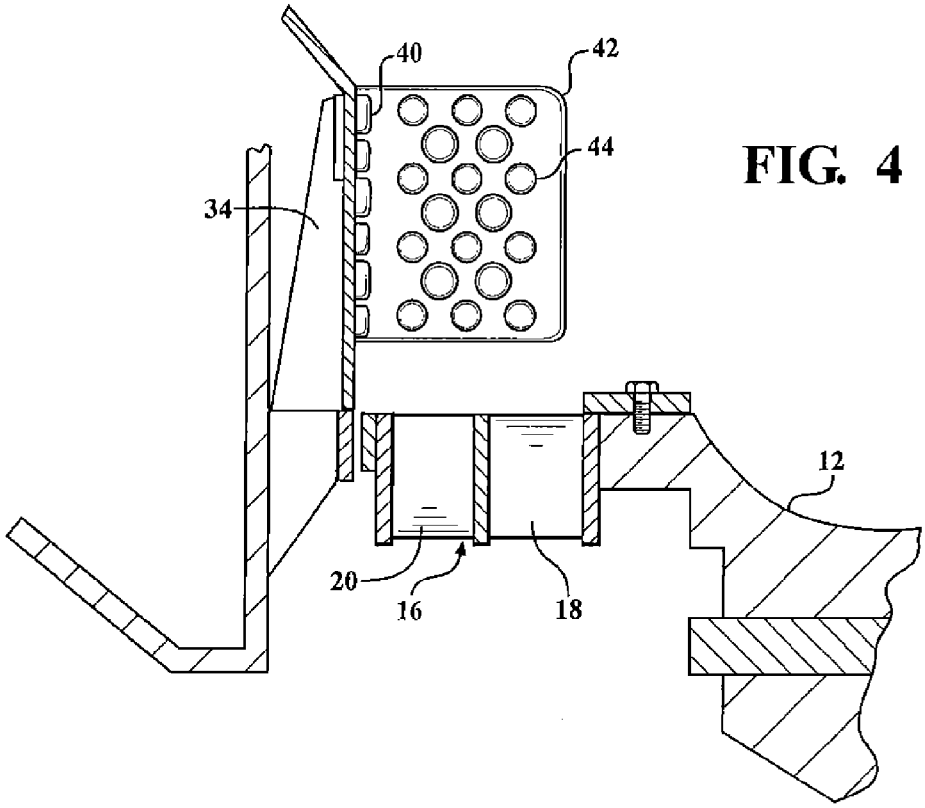
FIG. 4 is a sectional view of the rotatable vane structure and impactor structure of FIG. 3.

Attached to the bowl 12 in the embodiment of FIGS. 1, 3 and 4 is a double-course vane structure 16 comprising a first course of vanes 18 which are angled at 45° from vertical in one direction and a second course of vanes 20 concentric with the first course but angled in the reverse direction. Annular races 22, 24, 26 support the vanes 18, 20 therebetween, the entire structure being typically built in segments and welded together as will be apparent from the reading of the above-identified pending patent application Ser. No. 12/621,814. The vane structure 16 is shown in FIG. 3 to be bolted to the bowl 12.

A forced air system causes air to flow upwardly through the vane structure 16 whether or not the vane structure is rotating with the milling bowl 12. The upward movement of the air entrains particulate subject matter from the milling operation to cause upward flow thereof with the housing 10. The angles of the vanes 18, 20 are such as to cause an angled cross-flow of the air which in turn, causes the entrained particulates to impact both surfaces of impactor plates 42 which form part of segments 36 bolted to a ring structure 28 which is integral with the interior of the crusher/classifier housing 10. The ring structure 28 comprises an upper annular support ring 32 and a plurality of tapered radial reinforcing ribs 34 which are welded to the ring 32 as well as to a ledge 33 at the bottom of the structure 28. As such, the segments 36 can be bolted into place with bolts extending through the ring 32 whereupon the plates 42 extend at regular intervals radially inwardly toward the axis of rotation 14 such that they lie within the updraft airstream as described above. After hitting the impactor plates 42, air continues to flow upwardly to a classifier 43. If coal is the material being crushed, air and coal flow out to a combustion chamber via ducts 45.

The surfaces of the impactor plates 42 as well as the surfaces of the inserts 36 between the impactor plates are covered with coin-shaped, spaced-apart protrusions 44 and 40, respectively. The coverage is on the order of 50% to 85%. If a single course is used, only one surface of plates 42 need be coined; i.e., the surface impacted by air coming off of the vanes.

It will be appreciated that the height of the plates 42 is related to the spacing between the plates, those two parameters being selected such that effectively all of the particulate subject matter entrained in the airstream off of the vanes 18, 20 impacts a side of one or more of the plates 42. If the plates 42 are farther apart, they must be vertically longer; if they are vertically shorter, they must be closer together. The designer selects the optimum dimensions for economy of fabrication as well as efficacy of operation. In a workable embodiment, the plates are on the order of 14" high and the inserts are on the order of 14" wide.

It will also be appreciated that the invention can be used with single course rotating vane structures. As stated above, a single course of vanes angles the updraft air only one way and uses only one surface of plates 42.

As indicated above, the plates and inserts 36 between them are preferably made of a high hardness, wear resistant material such as a high hardness alloy of steel. Alternatively, they may be hard-faced or made of a carbide or metal oxide for maximum life.

Figure 5:
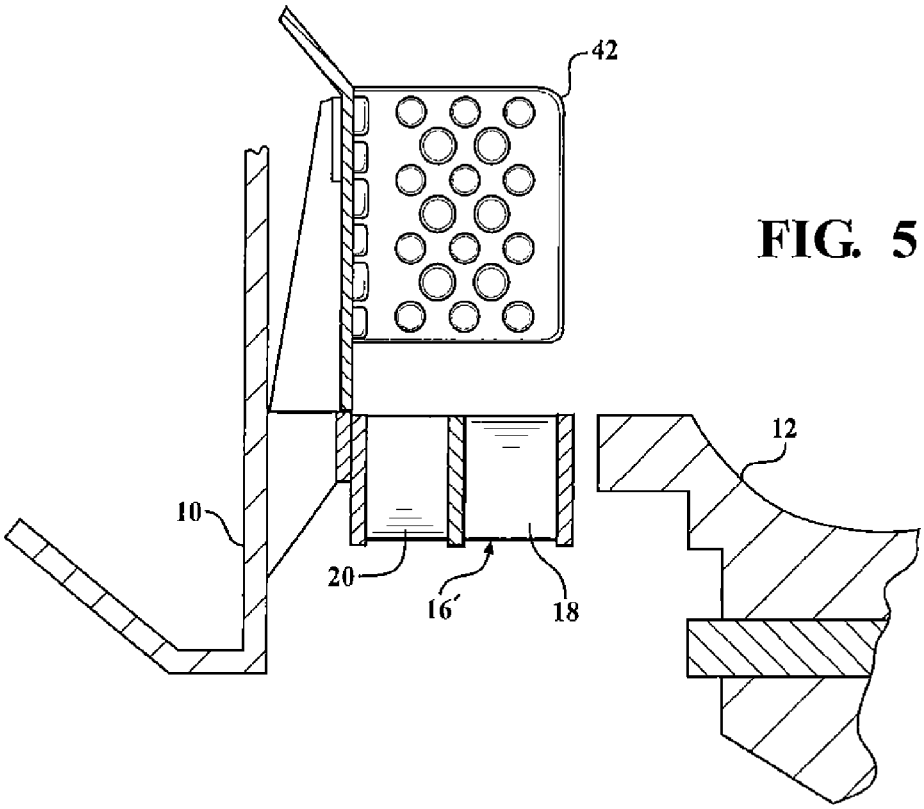
FIG. 5 is a sectional view of an embodiment in which the vane structure is attached to the crusher housing.
Figure 6:
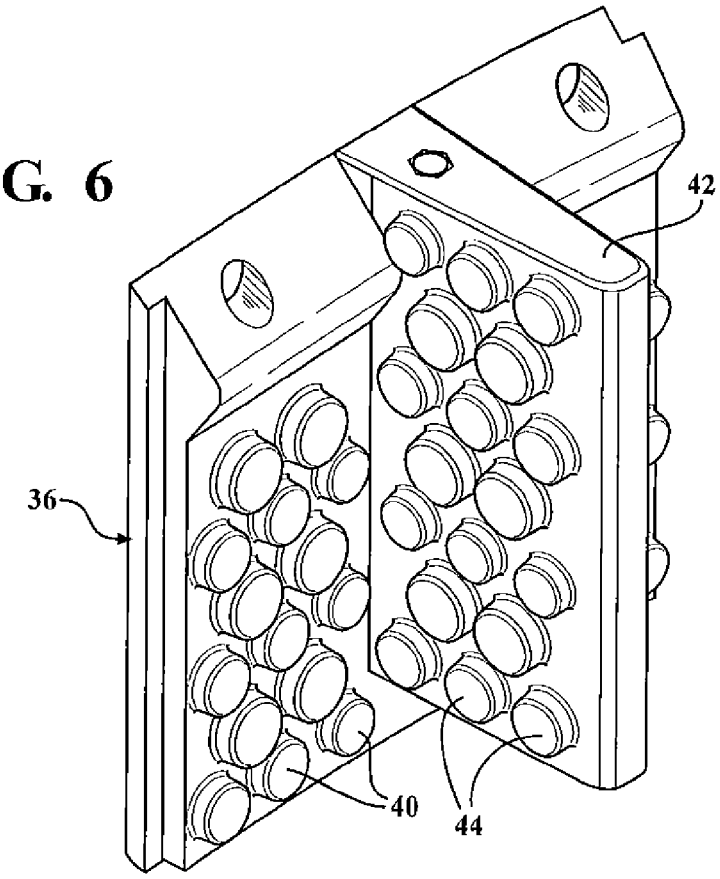
FIG. 6 is a perspective view of a prefabricated impactor section.
Figure 7:
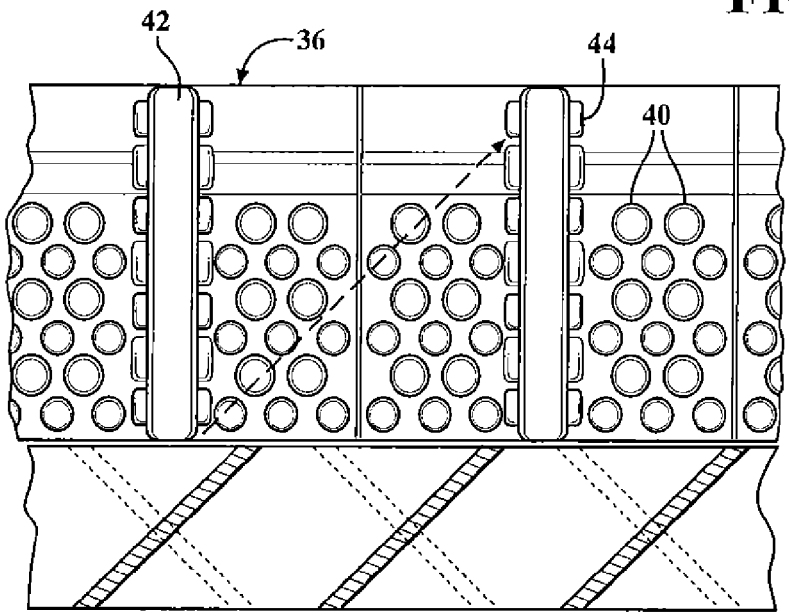
FIG. 7 is a plan view of several impactor sections above one course of a vane structure.

FIG. 5 shows an alternative construction in which the vane structure 16' is attached to the housing sidewall rather than to the periphery of the bowl 12. The vanes are again angled oppositely in the two courses and the vane structure 16' is directly below the impactor plates 42 so as to operate in essentially the same manner as the embodiment of FIGS. 1-4 and 7.

Figure 8:
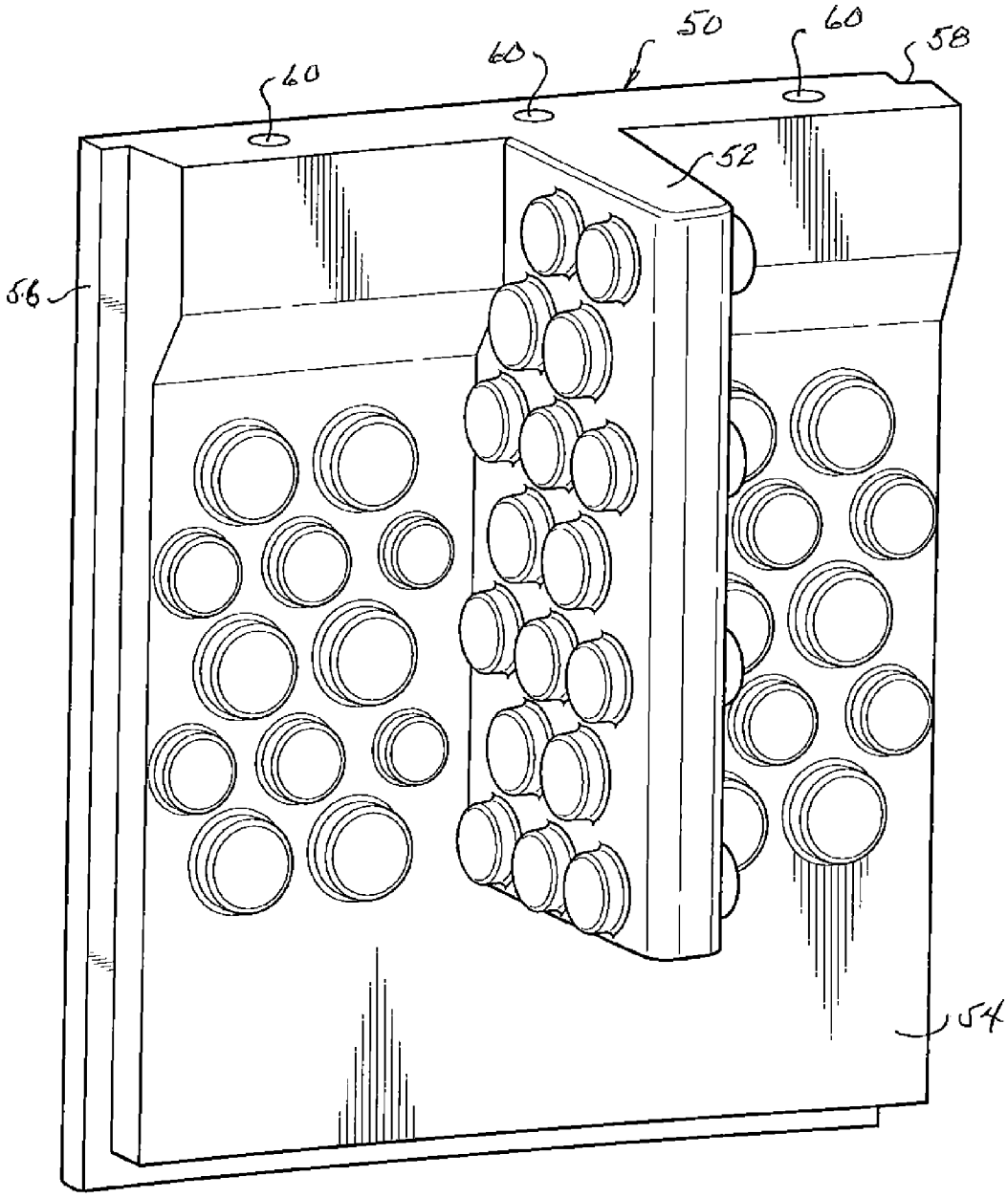
FIG. 8 is a perspective view of a single alternative impactor section.
Figure 9:
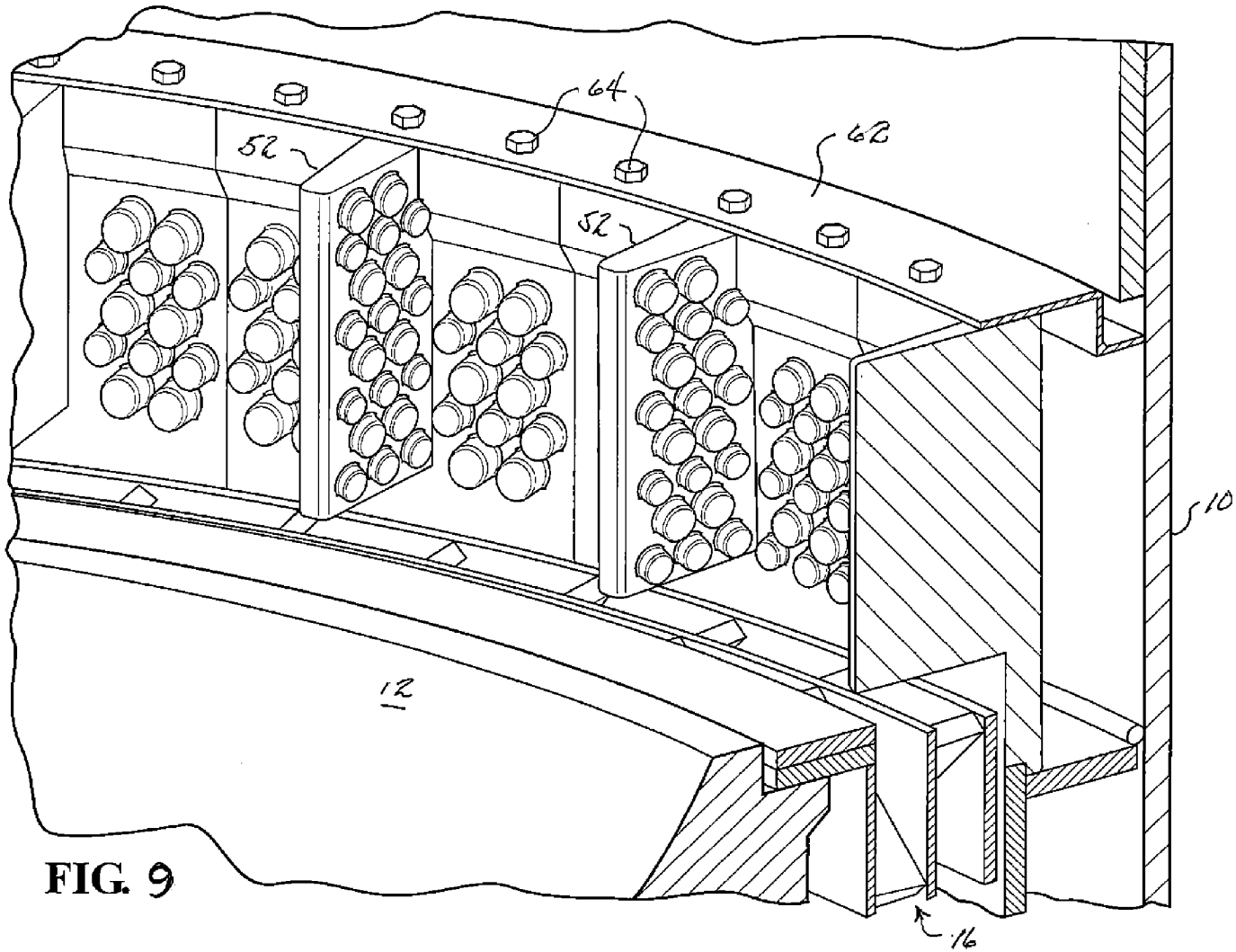
FIG. 9 is a partial perspective view of a series of impactor sections tied together by a top plate.

FIG. 8 shows a slightly different impactor segment 50 in which the plate 52 and the backer structure 54 are cast in one piece. The backer structure is stepped so that the tongue 56 on the left side (as seen in FIG. 8) fits into the groove or slot 58 on the right side of an adjacent segment as shown in FIG. 9 and holes 60 are formed and tapped in the top of the segment. A plate 62 is attached by bolts 64 to a series of segments to tie them together. Note that the coined surfaces of the plates 52 are truncated at the bottom to create a gap between the vane structure 16 and the plates 52. Both sides of plates 52 and the front surfaces of the backers 54 are coined.

In operation, coal enters the housing by gravity feed through chute 13. It works its way radially outwardly on the bowl 12 until it overflows the edge and gets picked up in the air streams coming off of the vanes 18, 20. The air and entrained coal immediately impacts the surfaces of plates 42, 52 which breaks the particles up into smaller pieces.

It will be appreciated that the embodiments illustrated in the drawing and described above are exemplary and that implementation of the invention can be carried out in various other configurations.

What is claimed is:

1. A structure for use in updraft classifier/crushers having an annular ring of angled vanes defining a flow path for air, comprising:

an annular support;

a plurality of vertically oriented, circumferentially spaced impactor plates fastened to and extending radially inwardly from said support and extending into said flow path; and the height and spacing of said impactor plates being such as to intercept a substantial portion of airborne particulates entrained in the air.

2. A structure as defined in claim 1 wherein said plates are substantially rectangular and have surfaces of a wear-resistant material.

3. A structure as defined in claim 1 wherein at least one outer surface of each of the plates has a pattern of protrusions thereon.

4. A structure as defined in claim 3 wherein the protrusions are essentially coin-shaped and are adjacent to but spaced from one another.

5. An updraft classifier/crusher comprising:

a housing defining a crusher chamber;

an annular vane ring mounted in said housing and having circumferentially spaced angled vanes disposed therein to define a flow path for air; and an impactor structure disposed adjacent and above said vane ring end comprising a plurality of circumferentially spaced, generally planar impactor plates disposed in said air path and oriented relative to said vanes such that substantial portion of particulates in said air is intercepted by said plates.

6. An updraft classifier/crusher as defined in claim 5 wherein each of said plates has a plurality of spaced-apart protrusions formed thereon.

7. An updraft classifier/crusher as defined in claim 5 wherein said plates are substantially vertical and said vanes are angled away from vertical so as to direct air into an impact relationship to an exposed surface of each of said plates.

8. An updraft classifier/crusher as defined in claim 5 wherein each of said plates is made of or covered with a wear-resistant material.

9. An updraft classifier/crusher as defined in claim 5 further comprising a mounting ring attached to an interior wall of said housing, each of said impactor structure plates being fastened to said mounting ring.

10. An updraft classifier/crusher as defined in claim 5 wherein the vane ring has first and second concentric courses, the vanes in the first course being angled opposite to the vanes in the second course.

11. An impactor structure for use in combination with an updraft crusher comprising:

an impactor plate having opposite parallel plane surfaces;

a plurality of protrusions arranged over at least one of said surfaces; and a backer plate attached to said impactor plate at substantially right angles thereto;

said impactor and backer plates being formed with highly wear-resistant surfaces materials.

* * * * *